US011940181B2

(12) United States Patent
Kakizaki

(10) Patent No.: US 11,940,181 B2
(45) Date of Patent: Mar. 26, 2024

(54) WATER HEATER

(71) Applicant: PALOMA CO., LTD, Nagoya (JP)

(72) Inventor: Yusuke Kakizaki, Nagoya (JP)

(73) Assignee: PALOMA CO., LTD, Nagoya (JP)

( * ) Notice: Subject to any disclaimer, the term of this patent is extended or adjusted under 35 U.S.C. 154(b) by 0 days.

(21) Appl. No.: 17/062,837

(22) Filed: Oct. 5, 2020

(65) Prior Publication Data

US 2021/0116149 A1 Apr. 22, 2021

(30) Foreign Application Priority Data

Oct. 17, 2019 (JP) ..... 2019-190490

(51) Int. Cl.
*F24H 9/02* (2006.01)
*F24H 9/00* (2022.01)

(52) U.S. Cl.
CPC ..... *F24H 9/02* (2013.01); *F24H 9/0005* (2013.01)

(58) Field of Classification Search
CPC . F24H 9/02; F24H 9/0005; F24H 9/06; F24H 1/181; B67D 3/0038
See application file for complete search history.

(56) References Cited

FOREIGN PATENT DOCUMENTS

| | | | | |
|---|---|---|---|---|
| CN | 109458736 A * | 3/2019 | | |
| DE | 8504219 U1 * | 5/1985 | ..... | F24H 9/02 |
| DE | 8504219 U1 * | 5/1985 | ..... | F24H 9/02 |
| FR | 2574168 A1 * | 6/1986 | ..... | F24H 9/02 |
| JP | S57028236 U | 2/1982 | | |
| JP | S62115056 U | 7/1987 | | |
| JP | 2002013827 A | 1/2002 | | |
| JP | 2015-155773 A | 8/2015 | | |
| JP | 2016156590 A | 9/2016 | | |
| JP | 6489868 B2 * | 3/2019 | ..... | F24H 9/02 |
| KR | 20030027654 A * | 4/2003 | | |
| KR | 200376698 Y1 | 3/2005 | | |
| KR | 200376698 Y1 * | 3/2005 | | |
| KR | 100693736 B1 * | 3/2007 | | |
| KR | 100693736 B1 * | 3/2007 | | |
| KR | 101885347 B1 * | 8/2018 | | |
| KR | 101885347 B1 * | 8/2018 | | |

OTHER PUBLICATIONS

English Translation of JP6489868B2, dated Apr. 21, 2022 (Year: 2022).*

(Continued)

*Primary Examiner* — Edelmira Bosques
*Assistant Examiner* — Brett Peterson Mallon
(74) *Attorney, Agent, or Firm* — Maier & Maier, PLLC

(57) ABSTRACT

The case of the water heater is composed of a box body having a rectangular shape in front view with a front face opened and a front cover having a shallower bottom and assembled on the front face of the box body. While rear side bent parts bent inward are each formed at front ends of left and right side plates of the box body, the front side bent parts bent inward are each formed at rear ends of left and right front side plates of the front cover and are abutted on the rear side bent parts in a state of being assembled to the box body. The inner bent parts folded backward are formed at inner end parts of the front side bent parts and are positioned on inner extension lines of the rear side bent parts in an assembled state.

3 Claims, 7 Drawing Sheets

(56) References Cited

OTHER PUBLICATIONS

English Translation of KR200376698Y1, dated Sep. 23, 2022 (Year: 2022).*
English Translation of KR20030027654A, dated Jan. 26, 2023 (Year: 2023).*
Office Action dated Jun. 27, 2023, in corresponding Japanese Application No. 2019-190490, 18 pages.

* cited by examiner

WATER HEATER

This application claims the benefit of the Japanese Patent Application Number 2019-190490 filed on Oct. 17, 2019, the entirety of which is incorporated by reference.

FIELD

The present disclosure relates to a water heater that heats water passing through a heat exchanger by combustion exhaust gas of a burner.

BACKGROUND

A water heater includes a case for housing a combustion apparatus provided with a burner and a heat exchanger etc., and the case is assembled on a front face of a box body whose five faces excluding the front face are closed by fixing a front cover with screws from the front.

For example, as disclosed in Japanese Unexamined Patent Application Publication No. 2015-155773, for this assembly of the front cover, four sides of an opening of the box body are formed with each bent part (flange) outside while four sides around the front cover are also formed with each bent part outside in the same way as the above to fix each of the bent parts with screws from the front.

SUMMARY

In this case, the appearance is deteriorated since the bent parts are protruded in the outer periphery of the case. Accordingly, if the bent parts of the box body and the front cover are each formed inward, left-right width thereof are made smaller to realize the slim design. However, since each of the bent parts is fixed with screws on the upper side and the lower side while merely abutting on each other on the left side face and the right side face, side faces of the box body are deformed by being bent inward, thereby impairing the design performance with high probability when impact is applied from the outside due to falling down of the box body in a posture where it is positioned below during transportation. Although one of the solutions to the above problem is that reinforcing plates are provided inside the box body in the left-right direction, the number of parts will be increased, causing increase in costs.

Accordingly, the present invention has been made to provide a water heater that can ensure the strength of side faces of a case and maintain the design performance while suppressing increase in costs even if bent parts of a box body and a front cover are formed inward.

In order to accomplish the above object, according to the first aspect of the present disclosure, it is provided a water heater including a case that houses a combustion apparatus.

The case composed of a box body having a rectangular shape in front view with a front face opened and a front cover formed in the same shape as the box body in front view and having a shallower bottom than that of the box body, the front cover assembled on the front face of the box body, wherein body side bent parts bent inward are each formed at front ends of left and right side plates of the box body.

The cover side bent parts bent inward are each formed at rear ends of left and right side plates of the front cover and are abutted on the body side bent parts in a state of being assembled to the box body.

The inner bent parts folded backward are formed at inner end parts of the cover side bent parts and are positioned on inner extension lines of the body side bent parts in an assembled state.

According to the second aspect of the present disclosure, the inner bent parts are formed in a plate shape which extends backward beyond the body side bent parts.

According to the third aspect of the present disclosure, the inner bent parts have an L-shaped cross section formed by being bent inward after extending beyond the body side bent parts.

According to the fourth aspect of the present disclosure, the inner bent parts are not in contact with the body side bent parts.

According to the fifth aspect of the present disclosure, the inner bent parts are in contact with the body side bent parts.

According to the embodiments of the invention, forming the inner bent parts can ensure the strength of side faces of the case while suppressing increase in costs even if the body side bent parts of the box body and the cover side bent parts of the front cover are formed by being bent inward. Also, the design performance can be maintained since the body side bent parts and the cover side bent parts do not protrude outside from the side faces of the case.

Especially, when the inner bent parts are formed in a plate shape which extends backward beyond the body side bent parts and have a L-shaped cross section formed by being bent inward after extending beyond the body side bent parts, the inner bent parts can be easily formed and the increase in the strength of the inner bent parts can be also expected.

Also, when the inner bent parts are not in contact with the body side bent parts, the body side bent parts can be collided with the inner bent parts by reducing a force of the body side bent parts heading toward the inside.

Further, when the inner bent parts are in contact with the body side bent parts, the body side bent parts and the inner bent parts are integrated, and thus the increase in the rigidity can be expected.

DETAILED DESCRIPTION

Hereinafter, the embodiment of the present invention will be described with reference to the drawings.

Figure 1:
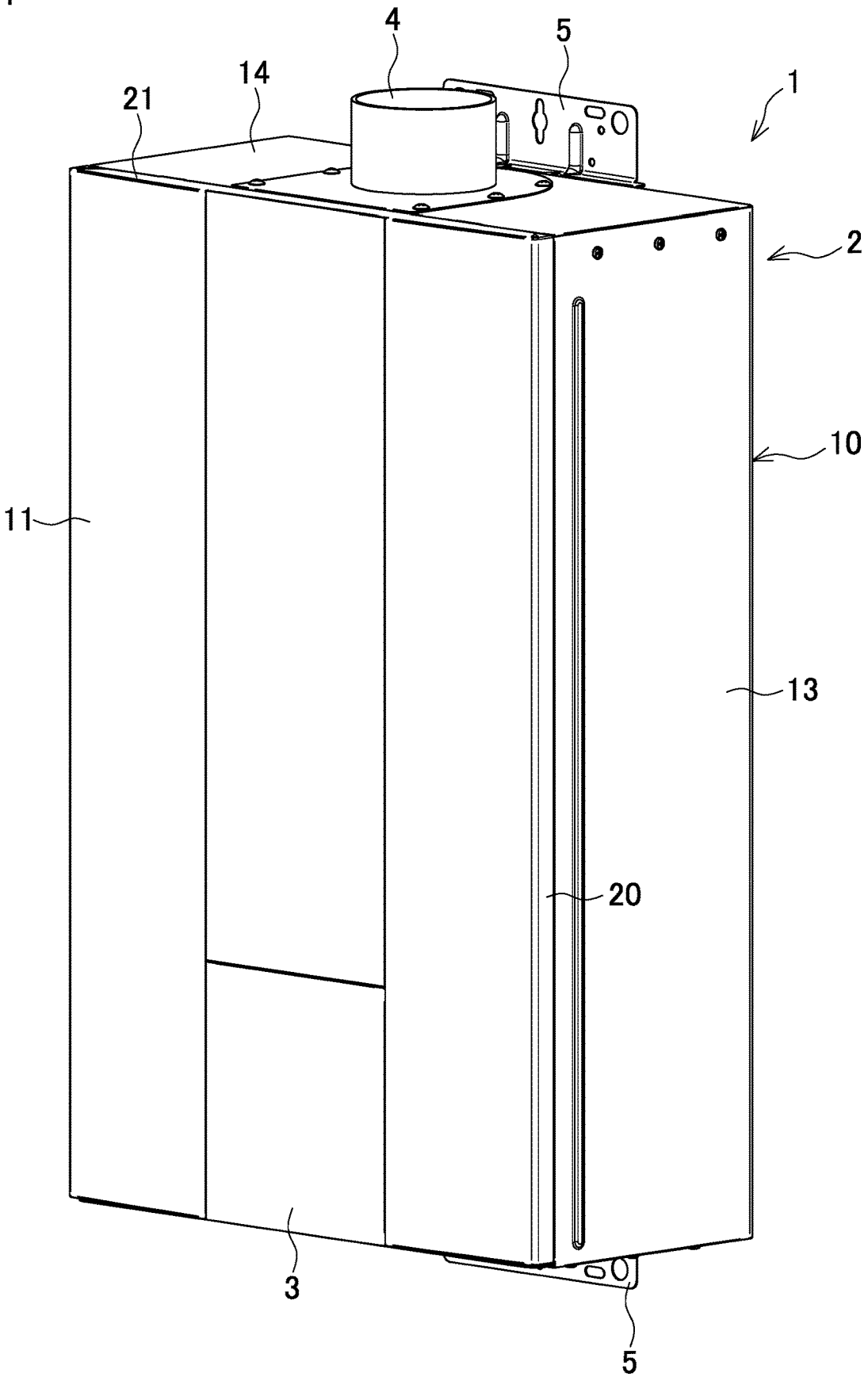
FIG. 1 is a perspective view of a water heater.

FIG. 1 is a perspective view showing one example of a water heater.

A water heater 1 includes a case 2 having a rectangular shape in front view, and a combustion apparatus (not shown) provided with a burner unit, a heat exchanger, an exhaust hood is installed inside the case 2. A display operation panel 3 is provided at a lower part of the front of the case 2, and an exhaust cylinder 4 of the exhaust hood is projected at an upper part of the case 2. Mounting brackets 5, 5 for installing the case 2 on an indoor wall etc. are provided on an upper side and a lower side of the rear of the case 2.

The case 2 is composed of a box body 10 having a deep bottom in the front-rear direction of opening a front face of the case 2 to house the combustion apparatus and a front cover 11 having a shallower bottom than that of the box body 10 to close the front face of the box body 10.

Figure 2:
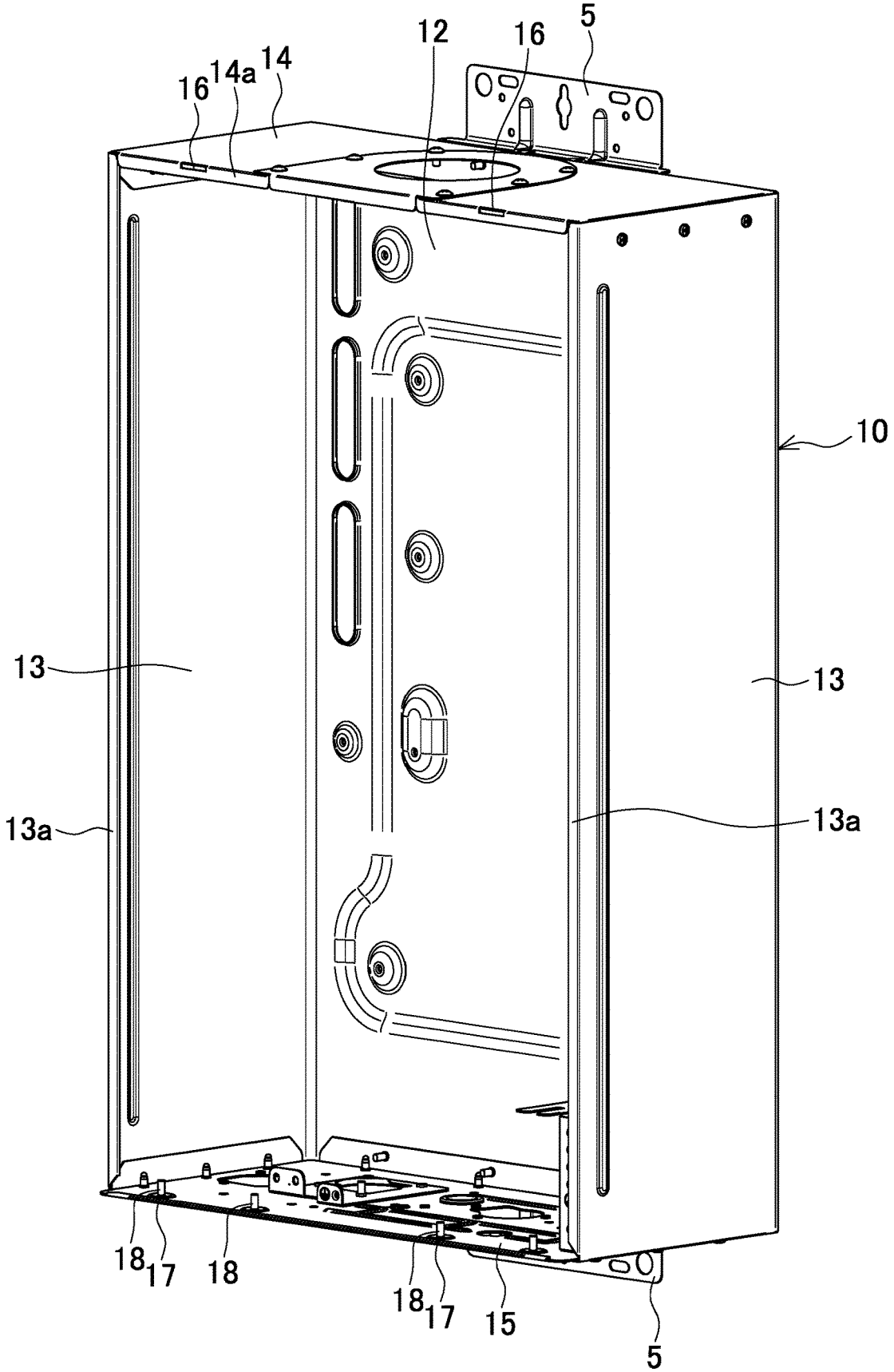
FIG. 2 is a perspective view seen from the front side of a box body.

As shown in FIG. 2, the box body 10 includes a back plate 12, left and right side plates 13, 13, a top plate 14, and a bottom plate 15.

Figure 4:
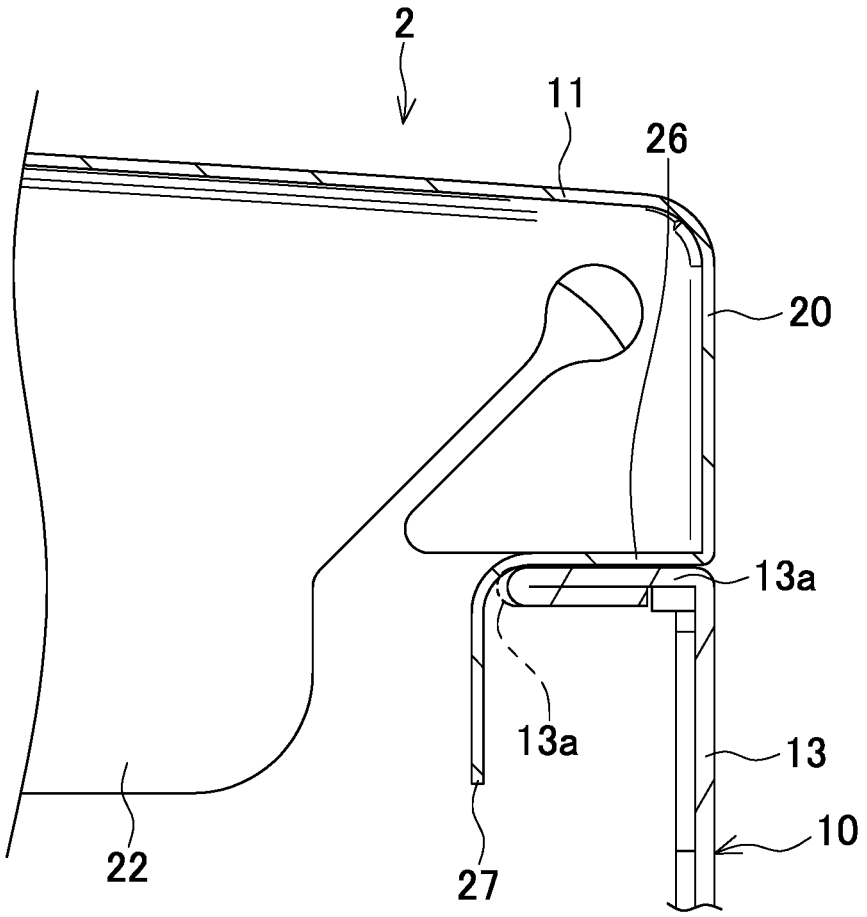
FIG. 4 is a cross sectional view of a part of a side face of a case.

Rear side bent parts 13*a*, 13*a*, 14*a* bent inward at a right angle are each formed at front ends of the side plates 13, 13 and a front end of the top plate 14. As shown in FIG. 4, inner end parts of the rear side bent parts 13*a*, 13*a* of the side plates 13, 13 are hemming bent so as to be folded backward at 180°. A pair of slits 16,16 is formed at the rear side bent 14*a* of the top plate 14.

The bottom plate 15 has a front end projected toward the front side relative to the side plates 13, 13, and mounting holes 17, 17 . . . of screws 18, 18 . . . are formed at the projected portion.

Figure 3:
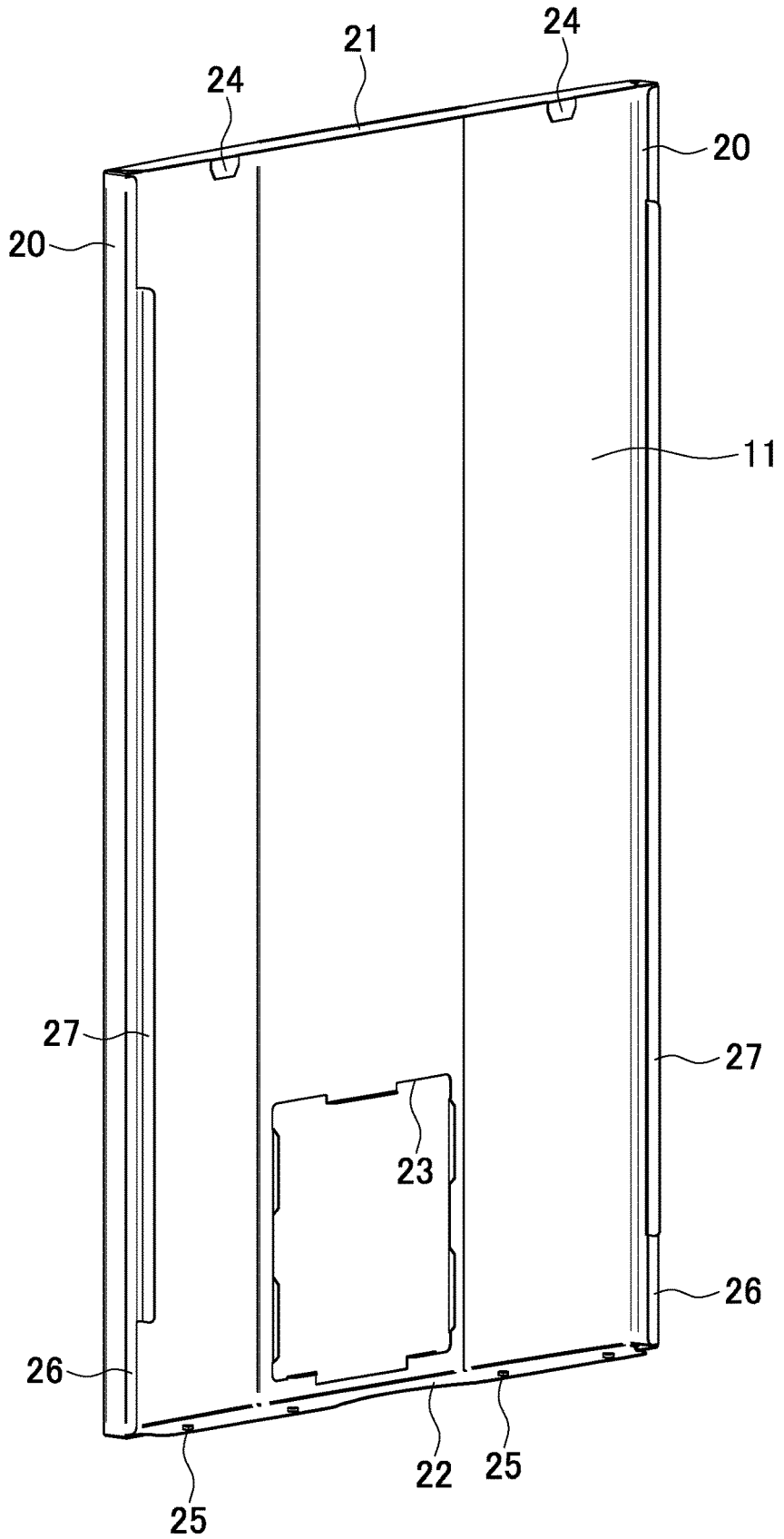
FIG. 3 is a perspective view seen from the rear side of a front cover.

As shown in FIG. 3, the front cover 11 has the same shape as the box body 10 in front view and includes left and right front side plates 20, 20, a front top plate 21, and a front bottom plate 22 with a rear face opened. A window 23 for the display operation panel 3 is formed at a central lower part of the front cover 11.

Claws 24, 24 that can be inserted into the slits 16, 16 of the top plate 14 of the box body 10 from the above are formed downward at a rear end of the front top plate 21. Screw holes 25, 25 . . . corresponding to the mounting holes 17, 17 . . . of the bottom plate 15 are formed in the front bottom plate 22.

Front side bent parts 26, 26 bent inward at a right angle are formed at rear ends of the front side plates 20, 20 in the opening of the rear face of the front cover 11. As shown in FIG. 4, the front side bent parts 26, 26 abut on the rear side bent parts 13*a*, 13*a* of the box body 10 in a state of being assembled to the box body 10, and widths of the front side bent parts 26, 26 in the left-right direction are larger than those of the rear side bent parts 13*a*, 13*a*. Also, plate-shaped inner bent parts 27, 27 bent backward at a right angle are formed at inner end parts of the front side bent parts 26, 26.

In the water heater 1 configured as described above, when the front cover 11 is mounted to the box body 10, the claws 24, 24 provided in the front top plate 21 of the front cover 11 are inserted into the slits 16, 16 provided in the rear side bent plate 14*a* of the top plate 14 of the box body 10 from the above. As a result of the above, the claws 24, 24 are engaged with the top plate 14, and the front bottom plate 22 of the front cover 11 is placed at the projected portion of the bottom plate 15 of the box body 10, which the front cover 11 is supported by suspension with the front face of the box body 10 closed. At this time, the front side bent parts 26, 26 of the front cover 11 abut on the rear side bent parts 13*a*, 13*a* of the side plates 13, 13. As shown in FIG. 4, the inner bent parts 27, 27 extends backward beyond inner extension lines of the rear side bent parts 13*a*, 13*a* in a state of not being in contact with the inner end parts of the rear side bent parts 13*a*, 13*a*. Accordingly, positioning of the front cover 11 can be easily performed at the time of assembly when positions of the inner bent parts 27, 27 are adjusted to insides of the rear side bent parts 13*a*, 13*a*.

When the screws 18, 18 . . . are inserted into the mounting holes 17, 17 . . . from the below of the bottom plate 15 to be screwed into the screw holes 25, 25, the front cover 11 is fixed to the box body 10. In this state, the side plates 13, 13 of the box body 10 and the front side plates 20, 20 of the front cover 11 form left and right side faces of the case 2 continuously in the front-rear direction.

The side plates 13, 13 of the box body 10 are going to be deformed inward when impact is applied to the side plates 13, 13 since the case 2 falls down in a posture where the box body 10 is positioned below and some object strongly hits the side faces of the case 2 during transportation of the water heater 1. However, as shown by a two-dot chain line in FIG. 4, an impact is absorbed because the inner end parts of the rear side bent parts 13*a*, 13*a* hit the inner bent parts 27, 27 of the front cover 11. Therefore, the inward deformation of the side plates 13, 13 is prevented. A simple structure to form the inner bent parts 27, 27 leads to increase in the strength of the side faces without employing any reinforcing members.

As described above, the case 2 that houses the combustion apparatus is composed of the box body 10 having the rectangular shape in front view with the front face opened and the front cover 11 formed in the same shape as the box body 10 in front view and having the shallower bottom than that of the box body 10. The front cover 11 assembled on the front face of the box body 10. The rear side bent parts 13*a*, 13*a* (body side bent parts) bent inward are each formed at the front ends of the left and right side plates 13, 13 of the box body 10. On the other hand, the front side bent parts 26, 26 (cover side bent parts) bent inward and abutting on the rear side bent parts 13*a*, 13*a* in a state of being assembled to the box body 10 are each formed at the rear ends of the left and right front side plates 20, 20 (side plates) of the front cover 11. Further, the inner bent parts 27, 27 folded backward and positioned on the inner extension lines of the rear side bent parts 13*a*, 13*a* in an assembled state are formed at the inner end parts of the front side bent parts 26, 26.

Consequently, even if the rear side bent parts 13*a*, 13*a* of the box body 10 and the front side bent parts 26, 26 of the front cover 11 are bent inward, the strength of the side faces of the case 2 can be ensured while suppressing the increase in costs. Also, the design performance can be maintained since the rear side bent parts 13*a*, 13*a* and the front side bent parts 26, 26 are not projected outside from the side faces of the case 2.

Especially, since the inner bent part 27 is formed in a plate shape which extends backward beyond the rear side bent part 13*a*, the inner bent part 27 can be easily formed and the inner bent part 27 is made longer, and thus the increase in the strength can be also expected.

Further, since the inner bent part 27 is not in contact with the rear side bent part 13*a*, the rear side bent part 13*a* can be collided with the inner bent part 27 by reducing a force of the rear side bent part 13*a* heading toward the inside.

Figure 5:
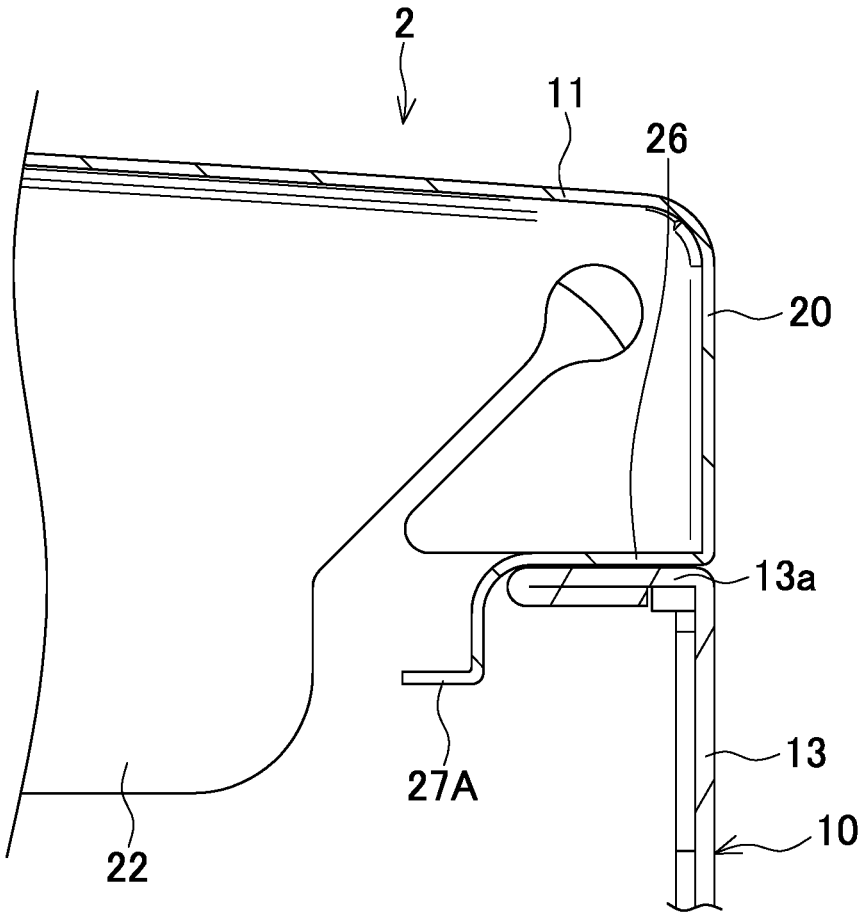
FIG. 5 is a cross sectional view of a part of the side face of the case and shows a variation of an inner bent part.

A shape of an inner bent part is not limited to the above. For example, as shown in FIG. 5, an inner bent part 27A may have an L-shaped cross section where the inner bent part 27A is bent inward after extending beyond the rear side bent part 13*a*. This structure increases the rigidity of the inner bent part 27A.

Figure 6:
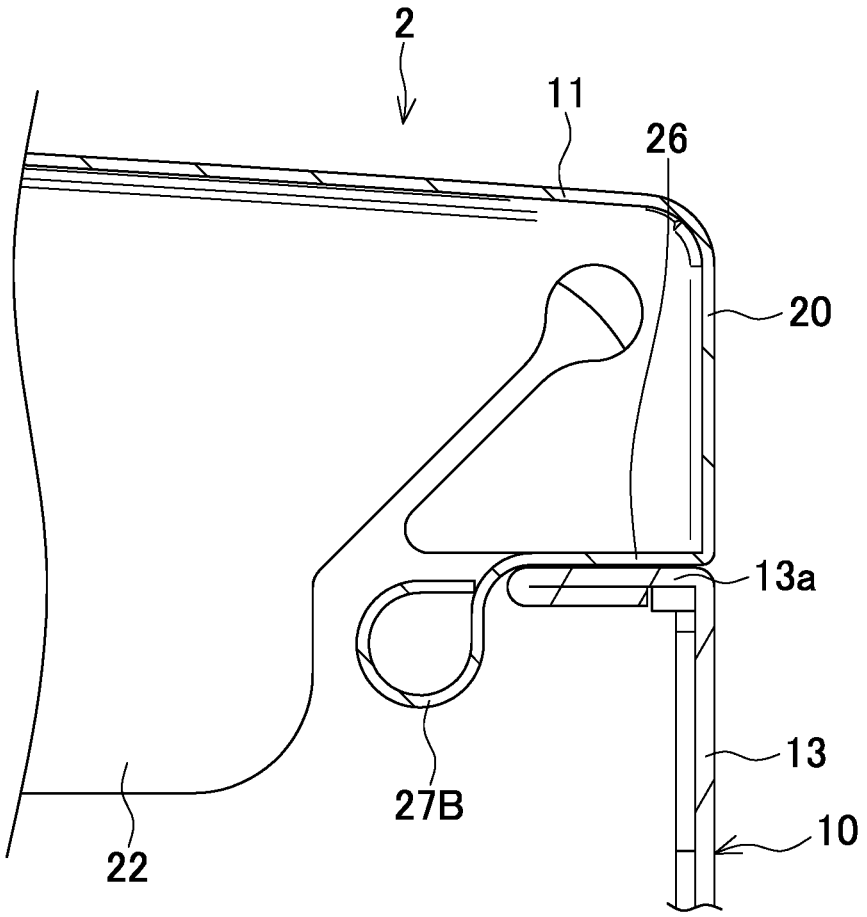
FIG. 6 is a cross sectional view of a part of the side face of the case and shows a variation of the inner bent part.

Also, as shown in FIG. 6, an inner bent part 27B may have a curled cross section wound inward after extending beyond the rear side bent part 13*a*. This structure increases the rigidity of the inner bent part 27B in the same way as the above. Further, an end part of the inner bent part 27 in FIG. 4 and an end part of the inner bent part 27A in FIG. 5 may be hemming bent. This structure also increases the rigidity of the inner bent part.

Figure 7:
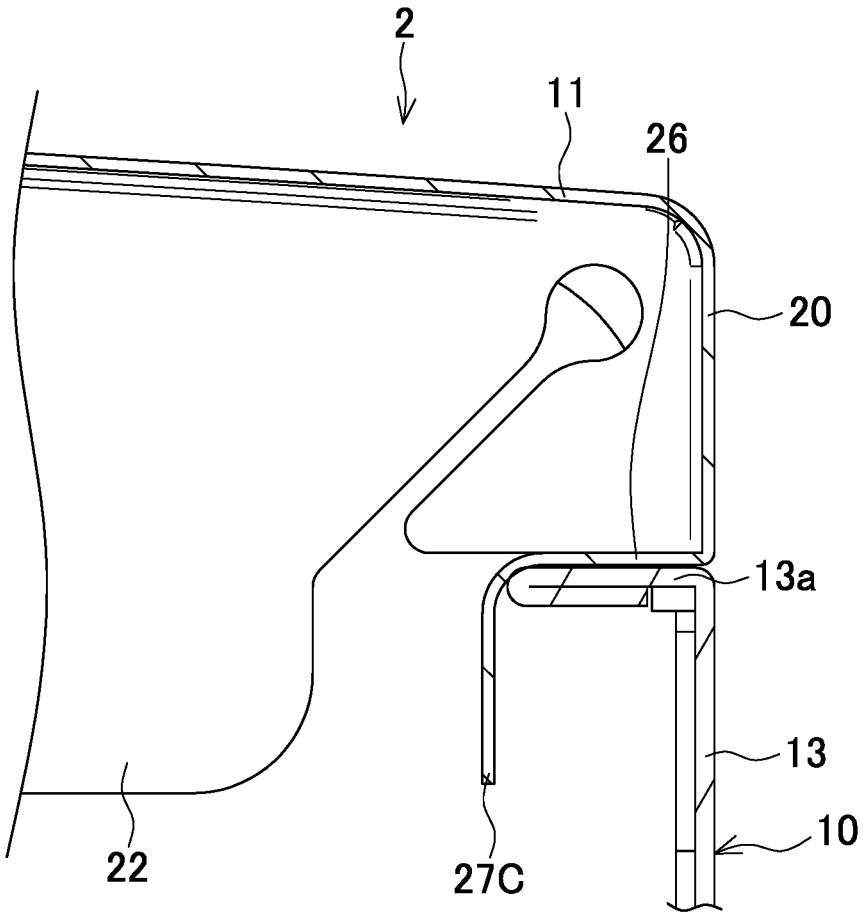
FIG. 7 is a cross sectional view of a part of the side face of the case and shows a variation of the inner bent part.

In addition, as shown in FIG. 7, the inner bent part 27 may be in contact with the rear side bent part 13*a* by being bent along the inner end part of the rear side bent part 13*a*. In this case, the rear side bent part 13*a* and the inner bent part 27 are integrated, and thus the increase in the rigidity can be expected. This contact structure can be also applied to the examples of FIGS. 5 and 6.

Besides, the width, height, depth etc. of the box body are not limited to the above, and the rear side bent part may not be hemming bent.

The depth of the front cover is also not limited to the above. The structure for assembling to the box body can be changed as necessary.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A water heater comprising a case, the case comprising:

a box body having a rectangular shape with a front face opened; and a front cover formed in a same shape as the box body in a front view and having a shallower bottom than that of the box body, wherein the front cover is assembled on the front face of the box body, body side bent parts bent inward are each formed at front ends of left and right side plates of the box body and hemming bent so as to be folded backward at substantially 180°, cover side bent parts bent inward are each formed at rear ends of left and right side plates of the front cover and are abutted on the body side bent parts in a state of being assembled to the box body, inner bent parts folded backward are formed at inner end parts of the cover side bent parts and are positioned on inner extension lines of the body side bent parts in an assembled state, the cover side bent parts are in full contact with the body side bent parts, the inner bent parts are not in contact with the body side bent parts prior to an impact, and the inner bent parts are configured to directly contact inner end parts of rear side bent parts of the box body after the impact, thereby absorbing the impact.

2. The water heater according to claim 1, wherein the inner bent parts are formed in a plate shape which extends backward beyond the body side bent parts.

3. The water heater according to claim 1, wherein the inner bent parts have an L-shaped cross section formed by being bent inward after extending beyond the body side bent parts.

* * * * *